US012589431B2

(12) United States Patent
Liang

(10) Patent No.: US 12,589,431 B2
(45) Date of Patent: Mar. 31, 2026

(54) INTELLIGENT TEMPERATURE CONTROL METHOD AND SYSTEM FOR DIE-CASTING DIE

(71) Applicant: ASSAB TOOLING TECHNOLOGY (SHANGHAI) CO., LTD., Shanghai (CN)

(72) Inventor: Chihchung Liang, Taiwan (CN)

(73) Assignee: ASSAB TOOLING TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 18/925,078

(22) Filed: Oct. 24, 2024

(65) Prior Publication Data

US 2025/0135530 A1 May 1, 2025

(30) Foreign Application Priority Data

Oct. 26, 2023 (CN) ..... 202311402465.5

(51) Int. Cl.
*B22D 17/32* (2006.01)

(52) U.S. Cl.
CPC ..... *B22D 17/32* (2013.01)

(58) Field of Classification Search
CPC ..... B22D 17/32; B22D 17/20; B22D 17/203; B22D 17/04; B22D 17/30; B22D 39/02; B22D 17/22; B22D 17/2218; B22D 2/00
USPC ..... 164/457, 154.6, 452, 4.1, 458, 113; 222/596; 266/236
See application file for complete search history.

(56) References Cited

U.S. PATENT DOCUMENTS 5,411,074 A * 5/1995 Naruse ..... G05D 23/27 164/151.4
6,592,354 B2 * 7/2003 Kachnic ..... B29C 45/7626 425/169
10,773,438 B2 * 9/2020 Panjwani ..... B29C 45/4225
12,111,275 B2 * 10/2024 Bellucco ..... B22D 46/00
2020/0338634 A1 * 10/2020 Richter ..... B22D 17/2218

FOREIGN PATENT DOCUMENTS

| | | | | |
|---|---|---|---|---|
| CN | 202087806 U | | 12/2011 | |
| CN | 108489622 A | | 9/2018 | |
| CN | 111879410 A | | 11/2020 | |
| CN | 112257303 A | | 1/2021 | |
| CN | 114054720 A | | 2/2022 | |
| CN | 115502367 | * | 12/2022 | ..... B22D 17/20 |
| JP | 5895672 B2 | | 3/2016 | |
| KR | 20200065232 A | | 6/2020 | |
| WO | 2022224563 A1 | | 10/2022 | |

OTHER PUBLICATIONS

CN115502367, Huang et al., Die-casting Thermal Image Visual System, Dec. 23, 2022 (Year: 2022).*

* cited by examiner

*Primary Examiner* — Jessee R Roe
*Assistant Examiner* — Michael Aboagye
(74) *Attorney, Agent, or Firm* — Bayramoglu Law Offices LLC

(57) ABSTRACT

Provided are intelligent temperature control method and system for die-casting die. Method includes setting target number of groups of temperature control regions and configuring initial temperature determination rule and initial temperature control strategy for each temperature control region; obtaining front-side thermal image of die using infrared camera mounted on both sides of spraying manipulator, and matching the same with CAD drawing of the die to obtain CAD thermal map of die; determining monitoring region on surface of die, and classifying monitoring regions into target number of groups of temperature control regions based on expected temperature requirement of die; calculating temperature value and determining temperature state of each monitoring region based on initial temperature determination rule of each temperature control region and temperature value of each monitoring region, and adjusting temperature of each monitoring region based on initial temperature control strategy of each temperature control region.

5 Claims, 3 Drawing Sheets

INTELLIGENT TEMPERATURE CONTROL METHOD AND SYSTEM FOR DIE-CASTING DIE

CROSS-REFERENCE TO RELATED APPLICATIONS

The present disclosure claims the priority to the Chinese patent application with the filling No. 2023114024655 filed with the Chinese Patent Office on Oct. 26, 2023, and entitled "INTELLIGENT TEMPERATURE CONTROL METHOD AND SYSTEM FOR DIE-CASTING DIE", the contents of which are incorporated herein by reference in entirety.

TECHNICAL FIELD

The present disclosure relates to the technology field of die-casting aluminum and magnesium alloys for automotive parts, and specifically to an intelligent temperature control method and system for a die-casting die.

BACKGROUND ART

The temperature monitoring and control of the die-casting dies directly affect the quality level, yield rate, and production efficiency of the parts, die service life, and maintenance costs. However, due to the high temperature, humidity, and pollution constraints in die-casting production environments, it is challenging to obtain the actual temperature field of the working die in the production site.

Currently, the traditional industry practice is to use software simulation to analyze the possible temperature distribution of the die cavity during operation, but it cannot accurately reflect the real situation. To address this, some companies have started using infrared devices to measure the temperature of the dies. However, since infrared devices are generally arranged on external environmental racks, the information obtained is severely distorted due to the far distance from the working die and the large angle of tilt. Additionally, with the development of large automotive die-casting parts in recent years, the geometric shapes of castings have become increasingly complex, with deeper cavities and more complex process conditions, thus requiring stronger control for local temperatures. Existing methods do not meet the high requirements for precise control of local temperatures.

SUMMARY

The present disclosure provides an intelligent temperature control method and system for a die-casting die to address the technical problem of the inability of existing technologies to meet the precise control of local temperatures on the die surface.

In a first aspect, the present disclosure provides an intelligent temperature control method for a die-casting die, wherein the method includes setting a target number of groups of temperature control regions and configuring an initial temperature determination rule and an initial temperature control strategy for each temperature control region;

moving a spraying manipulator to a center of a die cavity, obtaining a front-side thermal image (thermography) of the die using an infrared camera mounted on both sides of the spraying manipulator, and matching the front-side thermal image with a CAD drawing of the die to obtain a CAD thermal map of the die;

determining a monitoring region on a surface of the die based on geometric features of the CAD thermal map, and classifying each monitoring region into the target number of groups of temperature control regions based on an expected temperature requirement of the die; and calculating a temperature value of each monitoring region based on the CAD thermal map, determining a temperature state of each monitoring region based on the initial temperature determination rule of each temperature control region and the temperature value of each monitoring region, and adjusting a temperature of each monitoring region based on the initial temperature control strategy of each temperature control region.

According to the intelligent temperature control method for a die-casting die provided in the present disclosure, after the step of adjusting a temperature of each monitoring region based on the initial temperature control strategy of each temperature control region, the method further includes obtaining a die-casting die quality information of a current die and a real-time demand information of a user; and updating at least one of the expected temperature requirement of a next die, the initial temperature determination rule of the target number of groups of the temperature control regions, or the initial temperature control strategy of the target number of groups of the temperature control regions based on the die-casting die quality information of the current die and the real-time demand information of the user.

According to the intelligent temperature control method for a die-casting die provided in the present disclosure, the initial temperature determination rule comprises determination rules for at least three states of normal temperature, high temperature, and low temperature, and the initial temperature control strategy comprises temperature adjustment strategies for at least two states of high temperature and low temperature; and the step of calculating a temperature value of each monitoring region, determining a temperature state of each monitoring region based on the initial temperature determination rule of each temperature control region and the temperature value of each monitoring region, and adjusting the temperature of each monitoring region based on the initial temperature control strategy of each temperature control region, specifically includes: determining, for any temperature control region, the temperature state of each monitoring region based on the initial temperature determination rule and the temperature value of each monitoring region; determined that, if the temperature state of a monitoring region is in a normal state, no temperature adjustment is required for the monitoring region; and adjusting, if the temperature state of a monitoring region is in a high temperature state or a low temperature state, the temperature of the monitoring region based on the temperature adjustment strategy corresponding to the high temperature state or low temperature state.

According to the intelligent temperature control method for a die-casting die provided in the present disclosure, temperature adjustment parameters of the temperature adjustment strategy include at least one of the following: on/off of a valve corresponding to a cooling channel, a delayed opening time of the valve corresponding to the cooling channel, a temperature adjustment medium, a temperature of the temperature adjustment medium, and a flow rate of the temperature adjustment medium.

According to the intelligent temperature control method for a die-casting die provided in the present disclosure, the step of adjusting the temperature of the monitoring region based on the temperature adjustment strategy corresponding to the high temperature state or low temperature state includes: determining, for any monitoring region, the corresponding temperature adjustment strategy based on the temperature state of each monitoring region, and generating a temperature control command based on the temperature adjustment parameters of the temperature adjustment strategy; sending the temperature control command to the valve corresponding to the cooling channel of each monitoring region; and controlling, in response to the temperature control command, a valve corresponding to the cooling channel of each monitoring region to execute a corresponding temperature control command.

According to the intelligent temperature control method for a die-casting die provided in the present disclosure, the step of obtaining a front-side thermal image of the die using an infrared camera-mounted on both sides of the spraying manipulator includes: connecting the infrared camera wherein the infrared camera comprises a first infrared camera and a second infrared camera; and controlling the first infrared camera to obtain the front-side thermal image of a fixed die and controlling the second infrared camera to obtain the front-side thermal image of a moving die.

According to the intelligent temperature control method for a die-casting die provided in the present disclosure, the step of determining a monitoring region on a surface of the die based on geometric features of the CAD thermal map includes: determining the geometric features of the CAD thermal map based on a distribution of the cooling channel and determining a surface region of a die corresponding to the geometric features of the CAD thermal map as a monitoring region.

In a second aspect, the present disclosure provides an intelligent temperature control system for a die-casting die, wherein the system includes

- a setting unit, configured for setting a target number of groups of temperature control regions and configuring an initial temperature determination rule and an initial temperature control strategy for each temperature control region;
- an infrared camera configured for moving a spraying manipulator to a center of a die cavity, obtaining a front-side thermal image of the die using an infrared camera mounted on both sides of the spraying manipulator, and matching the front-side thermal image with a CAD drawing of the die to obtain a CAD thermal map of the die;
- a division unit, configured for determining a monitoring region on a surface of the die based on geometric features of the CAD thermal map, and classifying each monitoring region into the target number of groups of temperature control regions based on an expected temperature requirement of the die and/or the quality of the casting; and
- a control unit, configured for calculating a temperature value of each monitoring region based on the CAD thermal map, determining a temperature state of each monitoring region based on the initial temperature determination rule of each temperature control region and the temperature value of each monitoring region, and adjusting a temperature of each monitoring region based on the initial temperature control strategy of each temperature control region.

According to the intelligent temperature control system for a die-casting die provided in the present disclosure, the system further includes a communication unit, configured for connecting to external devices of the system, receiving information from each external device, and sending control commands to each external device, wherein the external devices comprises an infrared camera a die-casting machine, a jet cooler, an oil temperature machine, and a spraying manipulator; a-data bank, configured for storing temperature information of the die-casting die, wherein the temperature information comprises the CAD drawing of the die-casting die, a front-side thermal image, a process parameter of a die-casting machine, and a temperature adjustment parameter; and a quality management unit, configured for recording and analyzing the die-casting die quality information.

According to the intelligent temperature control system for a die-casting die provided in the present disclosure, the step of recording and analyzing the die-casting die quality information includes loading the CAD drawing of a casting and marking and recording a defect information of the casting; and loading the CAD drawing of the die and marking and recording a failure information of the die. Further evaluation the possible cause of the quality issues related to deviation of parameters, design of cooling layout and the casting parameters will lead to improving the die life, the yield of the castings and the cost reduction of the castings.

In summary, the intelligent temperature control method and system for a die-casting die provided by the present disclosure can enable a more realistic and accurate reflection of the actual temperature on the surface of the die cavity by acquiring the front-side thermal image at the center of the die cavity. The subsequent temperature analysis and control using the front-side thermal image further enhance the accuracy control of the die temperature. By matching the CAD drawing with the front-side thermal image, it is possible to more clearly and intuitively display the temperature at each monitoring region of the die-casting die. By pre-setting reusable initial temperature determination rules and initial temperature control strategies for the target number of groups of temperature control regions, the method not only achieves partitioned control of the die temperature but also greatly improves the efficiency of intelligent temperature control of the die temperature. By classifying each monitoring region into different temperature control regions and adjusting the temperature adjustment parameters of the corresponding cooling channels of each monitoring region based on the corresponding initial temperature control strategy of each temperature control region, the method allows for finer adjustment of the surface temperature of the die, thereby achieving precise control of local temperatures.

BRIEF DESCRIPTION OF DRAWINGS

In order to more clearly illustrate the specific embodiments of the present disclosure or the prior art, the drawings required to be used in the description of the embodiments or the prior art will be briefly introduced as follows. Obviously, the drawings described below are some embodiments of the present disclosure. Those of ordinary skill in the art, without paying inventive labor, may also obtain other drawings according to these drawings.

DETAILED DESCRIPTION OF EMBODIMENTS

In order to make the objectives, technical solutions, and advantages of the present disclosure clearer, the technical solutions in the present disclosure will be clearly and completely described below in conjunction with the drawings in the present disclosure. It is evident that the described embodiments are part of the embodiments of the present disclosure, but not all of the embodiments. Based on the embodiments of the present disclosure, all other embodiments obtained by those skilled in the art without inventive effort shall fall within the scope of protection of the present disclosure.

Figure 1:
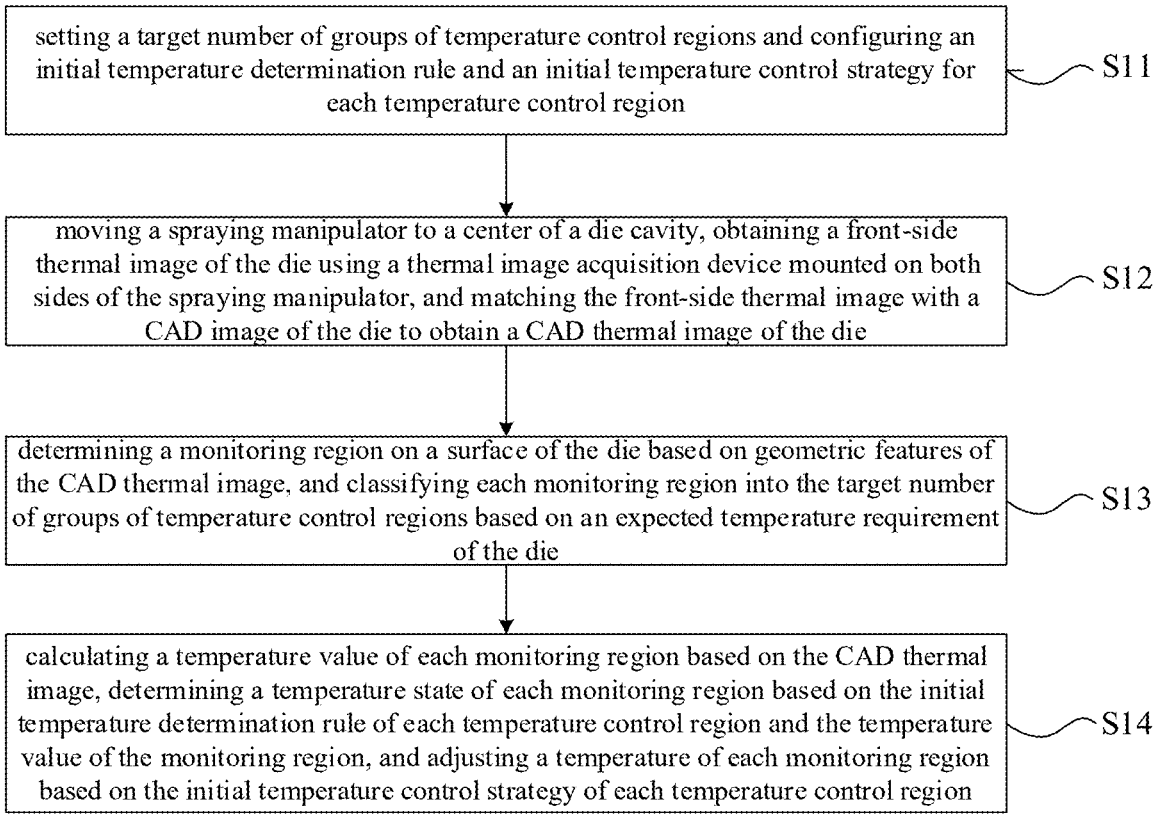
FIG. 1 is a flowchart of an intelligent temperature control method for a die-casting die provided by the present disclosure.

FIG. 1 is a flowchart of an intelligent temperature control method for a die-casting die provided by the present disclosure. Referring to FIG. 1, the method includes the following steps.

S11: setting a target number of groups of temperature control regions and configuring an initial temperature determination rule and an initial temperature control strategy for each temperature control region.

Specifically, it can be understood that as the geometric shapes of the castings become increasingly complex, the cavities of the die-casting dies become deeper, and the process conditions become more complex, the requirements for the temperature of the die-casting die surface also become higher. In the process of controlling the temperature difference within the die cavity to achieve thermal equilibrium, there are differences in temperature requirements for different die surfaces. Relying solely on a fixed set of temperature determination rules and corresponding temperature control strategies to adjust the die surface temperature cannot achieve precise adjustment of local temperatures on the die surface. Therefore, to make the die temperature more aligned with its actual needs, the temperature of the die surface needs to be controlled by partitioned regions.

Specifically, it can also be understood that the target number of groups of the temperature control regions can be preset in advance and reused for each subsequent die. The target number of groups of regions is determined based on the actual load and processing capability of the system, which is not limited by the present disclosure.

In some embodiments, the initial temperature determination rules and initial temperature control strategies can be initially determined based on the results of the die trial. Additionally, for a particular die-casting die, after determining the initial temperature determination rules and initial temperature control strategies for the target number of groups of the temperature control regions through the die-trial process, the initial temperature determination and initial temperature control strategies can be reused for each subsequent die in actual die-casting, or the initial temperature determination and initial temperature control strategies can be updated as actually needed.

The initial temperature determination rule comprises determination rules for at least three states of normal temperature, high temperature, and low temperature, such as defining the range of normal state, high temperature state, and low temperature state for any temperature control region. In some embodiments, high temperature and low temperature states can be further differentiated into "extremely high temperature, high temperature, slightly high temperature" and "extremely low temperature, low temperature, slightly low temperature" to better achieve precise control of the temperature of the die surface, which is not limited by the present disclosure. In other embodiments, different display colors can also be set for the temperatures in different states to directly and visually indicate the temperature state of the actual temperature on the die surface relative to the initial temperature determination rules, such as normal state shown in green, high temperature state shown in red, and low temperature state shown in blue, which is also not limited by the present disclosure.

The initial temperature control strategy includes temperature adjustment strategies for at least two states of high temperature and low temperature, where the temperature adjustment strategies of the initial temperature control strategy correspond one-to-one with the temperature states of the initial temperature determination rules. Different temperature states correspond to different temperature adjustment strategies, and no temperature adjustment is needed for the normal state, thus no corresponding adjustment strategy is required. Specifically, if the initial temperature determination rule includes determination rules for three states of normal temperature, high temperature, and low temperature, then the initial temperature control strategy includes temperature adjustment strategies for two states of high temperature and low temperature. If the initial temperature determination rule includes determination rules for five states of normal temperature, extremely high temperature, high temperature, extremely low temperature, and low temperature, then the initial temperature control strategy includes temperature adjustment strategies for four states of extremely high temperature, high temperature, extremely low temperature, and low temperature. If the initial temperature determination rule includes determination rules for seven states of normal temperature, extremely high temperature, high temperature, slightly high temperature, extremely low temperature, low temperature, and slightly low temperature, then the initial temperature control strategy includes temperature adjustment strategies for six states of extremely high temperature, high temperature, slightly high temperature, extremely low temperature, low temperature, and slightly low temperature.

The temperature adjustment parameters of the temperature adjustment strategy include at least one of the following: on/off of a valve corresponding to a cooling channel, a delayed opening time of the valve corresponding to the cooling channel a temperature adjustment medium, a temperature of the temperature adjustment medium, and a flow rate of the temperature adjustment medium.

The cooling channel is a pipeline for circulating the temperature adjustment medium, with each cooling channel independently distributed and not interconnected with each other. The relationship between the cooling channel and the valve can be a one-to-one correspondence, meaning one valve controls one cooling channel or the relationship between the cooling channel and the valve can be many-to-one, meaning multiple cooling channel are controlled by the same valve. For example, when the number of valves is limited, the cooling channel are required to share the valves.

The on/off state of the valve corresponding to the cooling channel is configured to determine whether the corresponding cooling channel is applied for temperature control. The delayed opening time of the valve corresponding to the cooling channel is configured to determine the time for the corresponding-cooling channel to circulate the temperature adjustment medium. For instance, for the punch head of a die-casting die or other common spot cooling positions or common line cooling positions that require constant cooling, the valve corresponding to the cooling channel of the corresponding monitoring region generally needs to be opened in real-time, meaning the delayed opening time is set to 0 s. Moreover, for high-pressure spot cooling positions on the die cavity surface that are in direct contact with the molten metal, the valve corresponding to the cooling channel of the corresponding monitoring region generally needs to be delayed in opening, with a typical delayed opening time of 3 s. This can be adjusted according to the die-casting time of the molten metal, which is not limited by the present disclosure.

The temperature adjustment medium is configured to determine the temperature adjustment medium for the corresponding cooling channel including water, oil, and other media. When the temperature adjustment medium is water, the cooling channel is generally configured to lower the temperature of the die surface. When the temperature adjustment medium is oil, cooling channel can be configured to maintain the temperature of the die surface or increase the temperature of the die surface.

The temperature of the temperature adjustment medium is configured to determine the temperature of the temperature adjustment medium in the corresponding cooling channel. For example, when the temperature adjustment medium is oil, by controlling the temperature of the oil entering the cooling channel to gradually increase, the surface temperature of the die will increase to varying degrees; by controlling the temperature of the oil entering the cooling channel to gradually decrease, the surface temperature of the die will decrease to varying degrees.

The flow rate of the temperature adjustment medium is configured to determine the flow rate of the temperature adjustment medium in the corresponding cooling channel. When the temperature adjustment medium is water, controlling the flow rate of water entering the cooling channel will cause the surface temperature of the die to change to varying degrees. When the temperature adjustment medium is oil and the oil temperature has not reached an oil temperature limit value, increasing or decreasing the oil temperature will cause the surface temperature of the die to change to varying degrees. When the temperature adjustment medium is oil and the oil temperature has reached an oil temperature limit value, controlling the flow rate of oil entering the cooling channel will also cause the surface temperature of the die to change to varying degrees.

Table 1 provides an example of the initial temperature determination rules and initial temperature control strategies for a certain temperature control region, where "+20" in the temperature of the temperature adjustment medium indicates increasing the oil temperature by 20° C., and "+10%" in the flow rate of the temperature adjustment medium indicates increasing the flow rate of the temperature adjustment medium by 10%. The values of the temperature range corresponding to each state and the temperature adjustment parameters in Table 1 are illustrative.

Referring to Table 1, when the temperature state is slightly high, the flow rate of water can be increased by 10%; when the temperature state is high, the flow rate of water can be increased by 20%; when the temperature state is extremely high, the water flow rate can be increased by 40%; when the temperature state is slightly low, the oil temperature can be increased by 20° C. and/or the flow rate of oil can be increased by 20%; when the temperature state is extremely low, the oil temperature can be increased by 40° C. and/or the flow rate of oil can be increased by 40%; and when the temperature state is extremely low, the oil temperature can be increased by 60° C. and/or the flow rate of oil can be increased by 50%.

TABLE 1

Initial temperature determination rules and initial temperature control strategies for a temperature control region that the strategy can be altered depending on the design and the actual needs.

| Initial temperature determination rule | | Initial temperature control strategy | | | | |
|---|---|---|---|---|---|---|
| state | temperature range/° C. | on/off of valve | delayed opening time of valve/s | temperature adjustment medium | temperature of temperature adjustment medium/° C. | flow rate of temperature adjustment medium |
| slightly high | 260-280 | open | 0 | water | / | +10% |
| high | 280-300 | open | 0 | water | / | +20% |
| temperature extremely high | 300-600 | open | 0 | water | / | +40% |
| slightly low | 220-240 | open | 0 | oil | +20 | +20% |
| low | 200-220 | open | 0 | oil | +40 | +40% |
| temperature extremely low | 0-200 | open | 0 | oil | +60 | +50% |

S12: moving a spraying manipulator to a center of a die cavity, obtaining a front-side thermal image of the die using an infrared camera device mounted on both sides of the spraying manipulator, and matching the front-side thermal image with a CAD drawing of the die to obtain a CAD thermal map of the die.

Specifically, it can be understood that as the geometric shapes of the casting become increasingly complex, and the cavities of the die-casting dies become deeper, if the thermal image of the die surface is obtained solely from the periphery of the die-casting die, the temperature data obtained cannot accurately reflect the temperature on the surface of the die cavity due to the long distance on one hand, and on the other hand, the temperature data obtained at an inclined angle have a large tilt angle, which leads to significant data distortion. Therefore, to improve the accuracy of the obtained temperature data, the infrared camera of the present disclosure is arranged inside the protective device of the spraying manipulator, so that the infrared camera can obtain the temperature data of the surface of the die cavity from the central position of the die cavity.

Specifically, it can also be understood that step S12 specifically includes the following step.

Step S121: moving a spraying manipulator to a center of a die cavity, obtaining a front-side thermal image of the die using an infrared camera mounted on both sides of the spraying manipulator.

More specifically, the front-side thermal image of the die refers to the front-side thermal image of the die obtained at the center of the die cavity before spraying, and the front-side thermal image of the die includes the front-side thermal image of the fixed die and the front-side thermal image of the moving die. The step of obtaining a front-side thermal image of the die using an infrared camera mounted on both sides of the spraying manipulator includes the following step.

Step a1: connecting the infrared camera, wherein the infrared camera comprises a first infrared camera and a second infrared camera.

The infrared camera is a simplified version of an infrared camera without control software configured. Compared to using a mature infrared camera with a supporting system, it eliminates the cumbersome hardware configuration and reduces costs. In addition, in the present disclosure, a collection unit is further independently developed and arranged based on the SDK (software development kit) provided by the infrared camera thus achieving the reading and storage of the thermal images collected by the infrared camera and meeting the automation requirements of temperature control for the die.

In some embodiments the first infrared camera and the second infrared camera are respectively arranged inside the first protective device and the second protective device, wherein the first protective device and the second protective device are mounted on both sides of the spraying manipulator. The first protective device and the second protective device can enable the first infrared camera and the second infrared camera to operate in harsh environments of high temperature, humidity, and water mist.

Step a2: controlling the first infrared camera to obtain the front-side thermal image of a fixed die and controlling the second infrared camera to obtain the front-side thermal image of a moving die.

Specifically, after moving the spraying manipulator to the center of the die cavity, i.e., to the middle position of the fixed die and the moving die after opening the die and removing the part, the position is both directly opposite the center of the fixed die cavity surface and directly opposite the center of the moving die cavity surface. Then, the first infrared camera and the second infrared camera are respectively applied to obtain the front-side thermal images of the fixed die and the moving die.

Step S122: obtaining the CAD drawing of the die, wherein the CAD drawing of the die refers to the CAD drawing obtained after filtering, simplifying, and transparent processing an original CAD drawing of the die. The original CAD drawing of the die includes geometric structures of the die-casting die, geometric elements corresponding to the cooling channel and valves, coordinate information, etc. The filtering process refers to removing a large number of splines generated in the original CAD drawing. The simplification process refers to removing annotation information and explanatory information in the original CAD drawing, retaining only feature information such as circles, lines, etc., such as the feature information of the cooling channel The transparent process refers to making the background of the original CAD drawing transparent to highlight the geometric features of the CAD drawing. The CAD drawing of the die is generally saved as a dxf format file, but it can also be saved as other format files; the present disclosure does not limit this.

Step S123: matching the front-side thermal image with a CAD drawing of the die to obtain a CAD thermal map of the die.

More specifically, both the front-side thermal image and the CAD drawing of the die are displayed on the interactive interface of the infrared camera, such as the image registration interface. Using the image registration tool, the front-side thermal image is matched with the CAD drawing of the die to obtain the CAD thermal map of the die.

The image adjustment tool includes a zoom tool, a move tool, a rotate tool, and a correction tool; and the step of matching the front-side thermal image with a CAD drawing of the die through the image adjustment tool includes the following steps.

Step b1: using the zoom tool to freely scale the CAD drawing of the die so that the size of the CAD drawing of the die matches the size of the front-side thermal image.

Step b2: determining the position of at least one identical geometric element in both the CAD drawing of the die and the front-side thermal image, determining, based on the position of at least one identical geometric element, the target position, and using the move tool to move the CAD drawing of the die to the target position.

Step b3: using the rotate tool to rotate the CAD drawing of the die.

In some embodiments, the rotate tool is an operating handle located at the eight corners of the image adjustment interface, and through each operating handle, any angle of the CAD drawing can be rotated to accurately align it with the front-side thermal image of the die.

Step b4: using the correction tool to correct the coordinate points of the front-side thermal image based on the coordinate points of the CAD drawing of the die.

After processing the CAD drawing of the die and the front-side thermal image through steps b1-b4 above, high-precision matching can be achieved. By correcting the coordinate points of the front-side thermal image, the CAD drawing of the die and the front-side thermal image can be more precisely aligned and matched. By superimposing the CAD drawing on the front-side thermal image, the temperature at various important positions of the die-casting die can be clearly and intuitively displayed.

S13: determining a monitoring region on a surface of the die based on geometric features of the CAD thermal map, and classifying each monitoring region into the target number of groups of temperature control regions based on an expected temperature requirement of the die.

Specifically, the geometric features of the CAD thermal map include a cooling channel. The step of determining a monitoring region on a surface of the die based on geometric features of the CAD thermal map includes Step S131: determining the geometric features of the CAD thermal map based on a distribution of the cooling channel and determining a surface region of a die corresponding to the geometric features of the CAD thermal map as a monitoring region.

The distribution of the cooling channel is presented as point features or line features in the CAD thermal map; for instance, the cooling channel at point cooling locations are distributed as point features, and the cooling channel at line cooling locations are distributed as line features.

Specifically, the geometric features of the CAD thermal map further include a die structural feature. The step of determining a monitoring region on a surface of the die based on geometric features of the CAD thermal map further includes: determining the geometric features of the CAD thermal map based on the die structural feature, and determining a surface region of a die corresponding to the geometric features of the CAD thermal map as a monitoring region. In other embodiments, the region of interest to the user can be determined as the monitoring region on the surface of the die, and the present disclosure does not limit this.

Step S132: classifying each monitoring region, into the target number of groups of temperature control regions based on an expected temperature requirement of the die.

The expected temperature requirements of the die include the expected temperature requirements for each monitoring region, generally determined based on the casting standards or the actual casting quality. The casting standards refer to the quality standards of the casting and the die-casting process parameters, and the actual casting quality refers to the quality of the castings obtained during trial casting or actual production. In some embodiments, if the user has specific requirements for the surface temperature of the die-casting die, the expected temperature requirements of the die can also be determined according to the requirements user, and the present disclosure does not limit this.

More specifically, the expected temperature requirements for each monitoring region are determined based on the expected temperature requirements of the die, and the normal temperature range for each temperature control region is determined based on the initial determination rules of each temperature control region, i.e., the corresponding temperature value range when the temperature is in normal state. Then, the expected temperature requirements of each monitoring region are matched with the normal temperature range of each temperature control region, thereby grouping the monitoring regions that fall within the same normal temperature range into the temperature control region corresponding to that normal temperature range.

It should be noted that if the expected temperature requirements of the die change, the corresponding temperature control regions can be also changed. Therefore, it is necessary to reclassify the regions according to the new expected temperature requirements, i.e., to assign them to the matching temperature control region.

S14: calculating a temperature value of each monitoring region based on the CAD thermal map, determining a temperature state of each monitoring region based on the initial temperature determination rule of each temperature control region and the temperature value of each monitoring region, and adjusting a temperature of each monitoring region based on the initial temperature control strategy of each temperature control region.

Specifically, the step S14 includes the following steps.

Step S141: calculating a temperature value of each monitoring region based on the CAD thermal map.

The temperature value of each monitoring region can be the average value of the temperature values of all points within the monitoring region, the maximum value of the temperature values of all points within the monitoring region, or the minimum value of the temperature values of all points within the monitoring region. The present disclosure does not limit this.

Step S142: determining a temperature state of each monitoring region based on the initial temperature determination rule of each temperature control region and the temperature value of each monitoring region, and adjusting the temperature of each monitoring region based on the initial temperature control strategy of each temperature control region.

Specifically, the step S142 includes the following steps.

Step c1: determining, for any temperature control region, the temperature state of each monitoring region based on the initial temperature determination rule and the temperature value of each monitoring region.

In some embodiments, for each monitoring region within any temperature control region, if the initial temperature determination rules of the temperature control region include the determination rules for seven states of normal, extremely high, high, slightly high, extremely low, low, and slightly low, the corresponding temperature state of each monitoring region within the temperature control region needs to be determined based on the temperature value of each monitoring region, identifying it as one of the seven states of normal, extremely high, high, slightly high, extremely low, low, and slightly low.

Step c2: determined that, if the temperature state of a monitoring region is in a normal state, no temperature adjustment is required for the monitoring region.

Step c3: adjusting, if the temperature state of a monitoring region is in a high temperature state or a low temperature state, the temperature of the monitoring region based on the temperature adjustment strategy corresponding to the high temperature state or low temperature state.

In some embodiments, for each monitoring region within any temperature control region, if the initial temperature determination rules of the temperature control region include the determination rules for seven states of normal, extremely high, high, slightly high, extremely low, low, and slightly low, then the monitoring regions in the extremely high state will adopt the temperature adjustment strategy corresponding to extremely high, the monitoring regions in the high state will adopt the temperature adjustment strategy corresponding to high, the monitoring regions in the slightly high state will adopt the temperature adjustment strategy corresponding to slightly high, the monitoring regions in the extremely low state will adopt the temperature adjustment strategy corresponding to extremely low, the monitoring regions in the low state will adopt the temperature adjustment strategy corresponding to low, and the monitoring regions in the slightly low state will adopt the temperature adjustment strategy corresponding to slightly low.

The step of adjusting the temperature of the monitoring region based on the temperature adjustment strategy corresponding to the high temperature state or low temperature state includes: determining, for any monitoring region, the corresponding temperature adjustment strategy based on the temperature state of each monitoring region, and generating a temperature control command based on the temperature adjustment parameters of the temperature adjustment strategy; sending the temperature control command to the valve corresponding to the cooling channel of each monitoring region; and controlling, in response to the temperature control command, a valve corresponding to the cooling channel of each monitoring region to execute a corresponding temperature control command.

The intelligent temperature control method for a die-casting die provided by the embodiments of the present disclosure can enable a more realistic and accurate reflection of the actual temperature on the surface of the die cavity by acquiring the front-side thermal image at the center of the die cavity. The subsequent temperature analysis and control using the front-side thermal image further enhance the accuracy control of the die temperature. By using an infrared camera tailored control software configured. By matching the CAD drawing with the front-side thermal image, it is possible to more clearly and intuitively display the temperature at each monitoring region of the die-casting die. By pre-setting reusable initial temperature determination rules and initial temperature control strategies for the target number of groups of temperature control regions, the method not only achieves partitioned control of the die temperature but also greatly improves the efficiency of intelligent temperature control of the die temperature. By classifying each monitoring region into different temperature control regions and adjusting the temperature adjustment parameters of the corresponding cooling channel of each monitoring region based on the corresponding initial temperature control strategy of each temperature control region, the method allows for finer adjustment of the surface temperature of the die, thereby achieving precise control for local temperatures.

Figure 2:
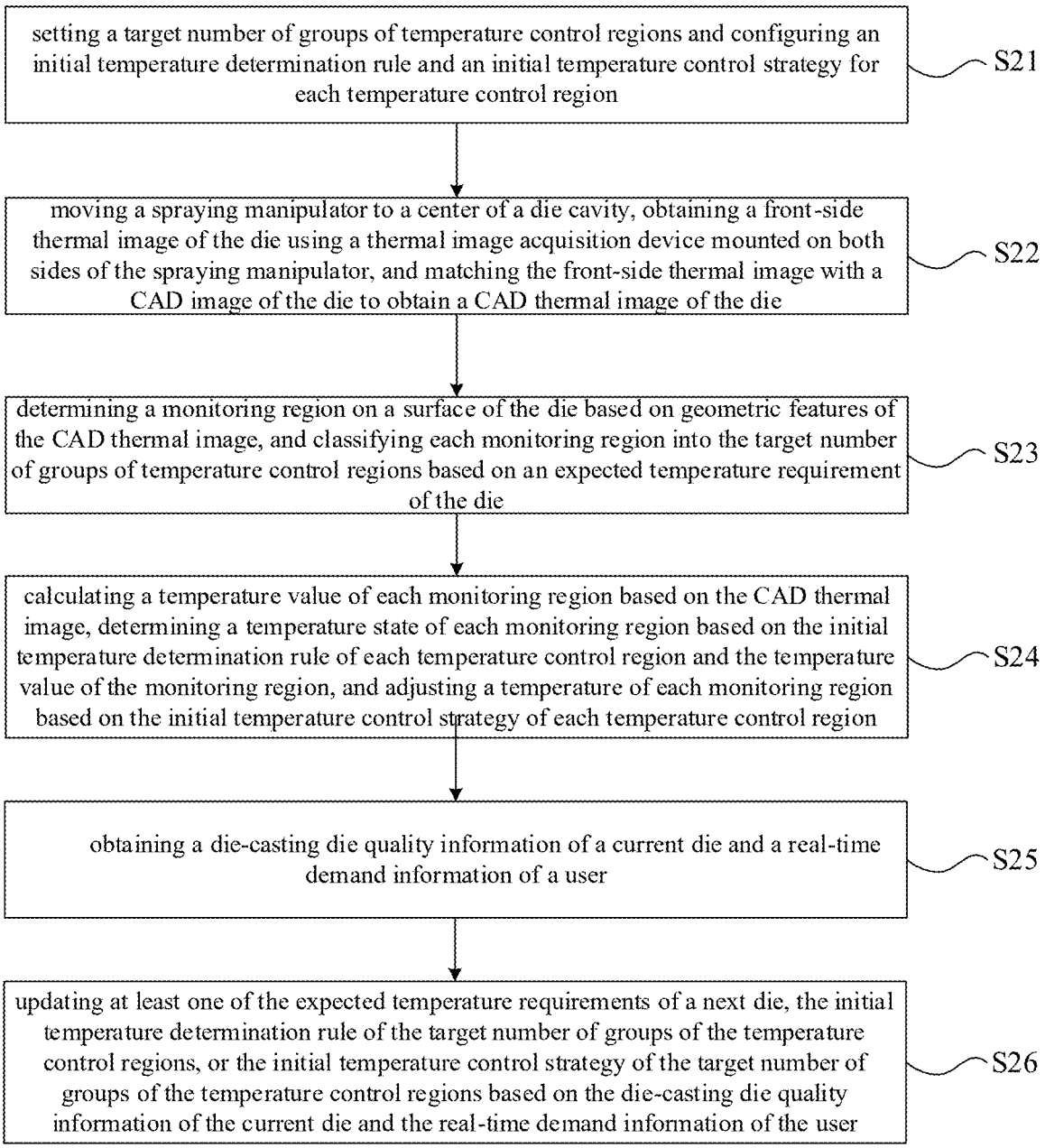
FIG. 2 is a flowchart of another intelligent temperature control method for a die-casting die provided by the present disclosure.

FIG. 2 is a flowchart of another intelligent temperature control method for a die-casting die provided by the present disclosure. Referring to FIG. 2, the method includes the following steps.

S21: setting a target number of groups of temperature control regions and configuring an initial temperature determination rule and an initial temperature control strategy for each temperature control region.

S22: moving a spraying manipulator to a center of a die cavity, obtaining a front-side thermal image of the die using an infrared camera mounted on both sides of the spraying manipulator, and matching the front-side thermal image with a CAD drawing of the die to obtain a CAD thermal map of the die.

S23: determining a monitoring region on a surface of the die based on geometric features of the CAD thermal map, and classifying each monitoring region into the target number of groups of temperature control regions based on an expected temperature requirement of the die.

S24: calculating a temperature value of each monitoring region based on the CAD thermal map, determining a temperature state of each monitoring region based on the initial temperature determination rule of each temperature control region and the temperature value of each monitoring region, and adjusting a temperature of each monitoring region based on the initial temperature control strategy of each temperature control region.

The above steps S21-S24 are the same as steps S11-S14. Steps S21-S24 are described in detail in the description of steps S11-S14 and will not be repeated here.

After step S24, the method further includes the following steps.

S25: obtaining a die-casting die quality information of a current die and a real-time demand information of a user.

The die-casting die quality information includes: defect information of the casting and failure information of the die. The defect information of the casting includes defects such as deformation, bubbles, pores, shrinkage cavities, shrinkage porosity, uneven surface, poor surface finish, etc. of the casting. The failure information of the die includes failure information such as cracking and wear of the die. The real-time demand information of the user refers to the temperature requirements of the user for the die-casting die obtained in the real-time.

S26: updating at least one of the expected temperature requirement of a next die, the initial temperature determination rule of the target number of groups of the temperature control regions, or the initial temperature control strategy of the target number of groups of the temperature control regions based on the die-casting die quality information of the current die and the real-time demand information of the user.

Specifically, it can be understood that the expected temperature requirements of the next die can be updated based on the die-casting die quality information and real-time demand information of the user from the current die. For example, if the die-casting die quality information presents a serious defect information, such as thermal shrinkage cavities due to excessively high local temperatures, the expected temperature requirements for the corresponding monitoring region at the defect location can be lowered to effectively adjust the temperature at the defect location. Alternatively, if the user re-specifies the temperature requirements for a specific position on the surface of the die-casting die, the expected temperature requirements for the corresponding monitoring region can be updated based on the demand information of the user. After updating the expected temperature requirements for each monitoring region, the monitoring regions can be re-assigned to the target number of groups of the temperature control regions, thereby allowing for flexible adjustments in the allocation for monitoring regions within the target number of groups of the temperature control regions. This enhances the flexible and accuracy control for the die temperature.

Additionally, it can be understood that the step of updating the initial temperature control strategy of the target number of groups of the temperature control regions based on the die-casting die quality information of the current die and the real-time demand information of the user, can be that, if the die-casting die quality information presents a defect information such as the presence of localized thermal shrinkage cavities, shrinkage porosity, and other defects, then it is determined that the temperature of the monitoring region belonging to the position of the casting defect needs to be further reduced. Also, for example, if defects such as incomplete filling, cold shut, or poor surface finish are present, then it is determined that the temperature of the monitoring region belonging to the position of the casting defect needs to be further increased. At this time, it is essential to determine the temperature control region in which the defect position of the temperature control region corresponding to the monitoring region and adjust the temperature adjustment strategy of the temperature control region to effectively regulate the temperature at the defect position.

It is important to note that after the initial temperature determination rules of the target number of groups of temperature control regions are determined during the die-trial process of the die-casting die, it is generally no need to update them if there are no significant changes. Only the expected temperature requirements of the die and the initial temperature control strategy of each temperature control region need to be updated. The significant change can be the change in the requirements for casting quality standards of the user, or it can be the impact of the failure information of the die-casting die on casting quality, and the like. The present disclosure does not limit this.

In another intelligent temperature control method for a die-casting die provided in the embodiments of the present disclosure, by classifying each monitoring region into different temperature control regions and adjusting the temperature adjustment parameters of the corresponding cooling channel of each monitoring region based on the corresponding initial temperature control strategy of each temperature control region, a precise control of local temperatures is achieved. At the same time, it is determined whether the expected temperature requirements for each monitoring region need to be updated based on the die-casting die quality information and the real-time demand information of the user. After updating the expected temperature requirements for each monitoring region, the monitoring regions can be re-assigned to the target number of groups of the temperature control regions, thereby allowing for flexible adjustments in the allocation for monitoring regions within the target number of groups of the temperature control regions. This enhances the flexibility and accuracy of control for the die temperature.

Figure 3:
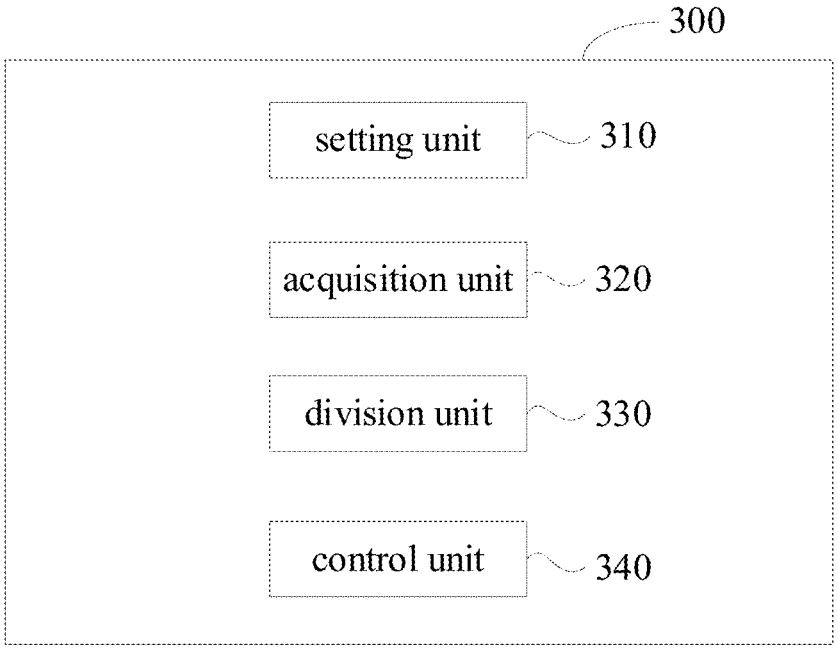
FIG. 3 is a schematic diagram of a structure of an intelligent temperature control system for a die-casting die provided by the present disclosure.

FIG. 3 is a schematic diagram of a structure of an intelligent temperature control system for a die-casting die provided by the present disclosure. Referring to FIG. 3, the system includes:

a setting unit 310, configured for setting a target number of groups of temperature control regions and configuring an initial temperature determination rule and an initial temperature control strategy for each temperature control region;

an infrared camera 320, configured for moving a spraying manipulator to a center of a die cavity, obtaining a front-side thermal image of the die using an infrared camera mounted on both sides of the spraying manipulator, and matching the front-side thermal image with a CAD drawing of the die to obtain a CAD thermal map of the die, wherein the infrared camera is independently developed and arranged based on the SDK provided by the infrared camera, which is configured for reading and storing the thermal images captured by the infrared camera; and it supports multiple formats of thermal image files, such as raw format, jpg format, and dxf format; and the infrared camera provides multiple functional interactive interfaces, including a file storage interface, a camera configuration interface, and an image registration interface, wherein the file storage interface is configured to manage file storage locations, the camera configuration interface is configured to set parameters such as the focal length of the infrared camera, and the image registration interface is configured to display and match the CAD drawing of the die with the front-side thermal image;

a division unit 330, configured for determining a monitoring region on a surface of the die based on geometric features of the CAD thermal map, and classifying each monitoring region into the target number of groups of temperature control regions based on an expected temperature requirement of the die and/or the quality of the casting; and a control unit 340, configured for calculating a temperature value of each monitoring region based on the CAD thermal map, determining a temperature state of each monitoring region based on the initial temperature determination rule of each temperature control region and the temperature value of each monitoring region, and adjusting a temperature of each monitoring region based on the initial temperature control strategy of each temperature control region.

The system further includes: a communication unit 350, a data bank 360, and a quality management unit 370 (not shown in the figure), wherein the communication unit 350 is configured for connecting to external devices of the system, receiving information from each external device, and sending control commands to each external device, wherein the external devices comprise an infrared camera a die-casting machine, an infrared camera, an oil temperature machine, and a spraying manipulator.

The communication between the communication unit and the infrared camera is achieved through a soft-trigger communication method. Specifically, in response to the spraying manipulator moving to the center of the die cavity, the control unit acquires the temperature adjustment strategies of the previous die and controls the infrared camera to capture the front-side thermal image of the die, thus ensuring more efficient communication between the control unit and the infrared camera.

The data bank 360 is configured for storing temperature information of the die-casting die, wherein the temperature information comprises the CAD drawing of the die-casting die, a front-side thermal image, a process parameter of a die-casting machine, and a temperature adjustment parameter.

The data bank 360 includes a local database and a cloud server. The cloud server is configured to promptly obtain the temperature information of the die-casting die during remote assistance so as to provide users with the best engineering solutions.

The quality management unit 370 is configured for recording and analyzing the die-casting die quality information.

The step of recording and analyzing the die-casting die quality information includes: loading the CAD drawing of a casting and marking and recording a defect information of the casting; and loading the CAD drawing of the die and marking and recording a failure information of the die.

For a detailed description of the intelligent mold temperature control system for the die-casting die mentioned above, it is referred to the descriptions of the relevant steps in the embodiments of the intelligent mold temperature control method for the die-casting die. Repetitions are not reiterated here.

An intelligent temperature control system for a die-casting die is provided in the present disclosure. By presetting reusable initial temperature determination rules and initial temperature control strategies for the target number of groups of temperature control regions through a setting unit, the method not only achieves partitioned control of the die temperature but also greatly improves the efficiency of intelligent temperature control of the die temperature. By using the infrared camera to obtain the front-side thermal image of the die, the actual temperature of the surface of the die cavity is more accurately and realistically reflected. Utilizing the front-side thermal image for subsequent temperature analysis and control further enhances the control accuracy of the die temperature. Through the division unit, each monitoring region is allocated to different temperature control regions. The control unit adjusts the temperature adjustment parameters of the corresponding cooling channel for each monitoring region, thus achieving precise control of local temperatures. By updating the expected temperature requirements for each monitoring region based on the die-casting die quality information and the real-time demand information of the user, and by re-assigning each monitoring region into the target number of groups of the temperature control regions, the flexible adjustments are enabled in the allocation for monitoring regions within the target number of groups of the temperature control regions, thereby enhancing the flexibility and accuracy of control of the die temperature.

The embodiments of the intelligent mold temperature control method and system for a die-casting mold described above are merely illustrative. The "units" used as a description of a separate part can be a combination of software and/or hardware that achieves the intended functions, and they can or cannot be physically separated. Some or all of these modules can be selected according to actual needs to achieve the objective of the embodiment. A person of ordinary skill in the art will be able to understand and implement them without inventive labor.

Finally, it should be noted that the above embodiments are merely intended to illustrate the technical solutions of the present disclosure and not to limit them. Although the present disclosure has been described in detail with reference to the aforementioned embodiments, those skilled in the art should understand that they can still make modifications to the technical solutions described in the foregoing embodiments or make equivalent replacements of some of the technical features therein. These modifications or replacements do not depart from the spirit and scope of the technical solutions of the respective embodiments of the present disclosure and should all be encompassed within the protection scope of the present disclosure.

What is claimed is:

1. A temperature control method for a die-casting die, characterized in that the method comprises setting, by a setting unit, a target number of temperature control regions and configuring, by the setting unit, an initial temperature determination rule and an initial temperature control strategy for each temperature control region, wherein the initial temperature determination rule comprises at least a normal temperature state, a high temperature state, a low temperature state, and their respective corresponding temperature ranges, and the initial temperature control strategy comprises temperature adjustment strategies for at least the high temperature state and the low temperature state, wherein a temperature adjustment strategy corresponding to the high temperature state is to lower the temperature, and a temperature adjustment strategy corresponding to the low temperature state is to increase the temperature;

moving a spraying manipulator with two sides to a center of a die cavity, obtaining a front-side thermal map of the die using an infrared camera mounted on both sides of the spraying manipulator, and matching the front-side thermal map with a CAD drawing of the die to obtain a CAD thermal map of the die;

determining, by a division unit, a plurality of monitoring regions on a surface of the die based on geometric features of the CAD thermal map, and assigning, by the division unit, each monitoring region to a temperature control region with a normal temperature range corresponding to the normal temperature state based on an expected temperature requirement of the die, wherein the expected temperature requirement of the die comprises an expected temperature range of each monitoring region, and the expected temperature range is matched with the normal temperature range; and calculating, by a control unit, a temperature value of each monitoring region based on temperature values of all points within the monitoring region displayed in the CAD thermal map, determining, by the control unit, a temperature state of each monitoring region based on the initial temperature determination rule of each temperature control region and the temperature value of each monitoring region, and adjusting, by the control unit, a temperature of each monitoring region based on the initial temperature control strategy of each temperature control region and the temperature state of each monitoring region; wherein the geometric features of the CAD thermal map comprise a cooling channel, and a distribution of the cooling channel is presented as point features or line features in the CAD thermal map; the step of determining a monitoring region on a surface of the die based on geometric features of the CAD thermal map comprises determining the geometric features of the CAD thermal map as the point features or the line features, and determining a surface region of the die corresponding to a point feature or a line feature as a monitoring region;

the step of calculating, by the control unit, a temperature value of each monitoring region based on temperature values of all points within the monitoring region displayed in the CAD thermal map, determining, by the control unit, a temperature state of each monitoring region based on the initial temperature determination rule of each temperature control region and the temperature value of each monitoring region, and adjusting, by the control unit, a temperature of each monitoring region based on the initial temperature control strategy of each temperature control region and the temperature state of each monitoring region, comprises:

determining, for any temperature control region, by the control unit, a temperature state of each monitoring region based on the initial temperature determination rule and the temperature value of each monitoring region; wherein the temperature state is the normal temperature state when the temperature value is in the normal temperature range corresponding to the normal temperature state, the temperature state is the high temperature state when the temperature value is in a temperature range corresponding to the high temperature state, or the temperature state is the low temperature state when the temperature value is in a temperature range corresponding to the low temperature state;

determining that, when the temperature state of a monitoring region is in a normal temperature state, no temperature adjustment is required for the monitoring region;

lowering, by the control unit, when the temperature state of a monitoring region is in a high temperature state, a temperature of the monitoring region through the cooling channel based on the temperature adjustment strategy corresponding to the high temperature state; or increasing, by the control unit, when the temperature state of a monitoring region is in a low temperature state, a temperature of the monitoring region through the cooling channel based on the temperature adjustment strategy corresponding to the low temperature state.

2. The temperature control method for the die-casting die according to claim 1, wherein after the step of adjusting a temperature of each monitoring region based on the initial temperature control strategy of each temperature control region and the temperature state of each monitoring region, the method further comprises obtaining a die-casting die quality information of a current die and a real-time demand information of a user, wherein the die-casting die quality information comprises: a defect information of a casting and a failure information of the die; and updating at least one of an expected temperature requirement, the initial temperature determination rule of the target number of the temperature control regions, or the initial temperature control strategy of the target number of the temperature control regions of a next die based on the die-casting die quality information of the current die and the real-time demand information of the user.

3. The temperature control method for the die-casting die according to claim 1, wherein temperature adjustment parameters of the temperature adjustment strategy comprise at least one of on/off of a valve controlling the cooling channel, a delayed opening time of the valve controlling the cooling channel, a temperature adjustment medium, a temperature of the temperature adjustment medium, and a flow rate of the temperature adjustment medium.

4. The temperature control method for the die-casting die according to claim 3, wherein the step of adjusting a temperature of the monitoring region based on a temperature adjustment strategy corresponding to the high temperature state or the low temperature state comprises:

determining, for any monitoring region, a corresponding temperature adjustment strategy based on the temperature state of each monitoring region, and generating a temperature control command based on the temperature adjustment parameters of the temperature adjustment strategy;

sending the temperature control command to the valve corresponding to the cooling channel of each monitoring region; and controlling, in response to the temperature control command, the valve corresponding to the cooling channel of each monitoring region to execute a corresponding temperature control command.

5. The temperature control method for the die-casting die according to claim 1, wherein the step of obtaining a front-side thermal map of the die using an infrared camera mounted on both sides of the spraying manipulator comprises:

connecting the infrared camera, wherein the infrared camera comprises a first infrared camera and a second infrared camera; and controlling the first infrared camera to obtain a front-side thermal map of a fixed die and controlling the second infrared camera to obtain a front-side thermal map of a moving die.

* * * * *